US006619623B1

(12) United States Patent
Kobelt

(10) Patent No.: US 6,619,623 B1
(45) Date of Patent: Sep. 16, 2003

(54) CHAIN PULLING DEVICE

(76) Inventor: Jacob Kobelt, 1654 Ocean Park Road, Surrey, British Columbia (CA), V4A 3L9

( * ) Notice: Subject to any disclaimer, the term of this patent is extended or adjusted under 35 U.S.C. 154(b) by 0 days.

(21) Appl. No.: 10/143,348

(22) Filed: May 10, 2002

(51) Int. Cl.[7] ..... B66D 1/00
(52) U.S. Cl. ..... 254/259; 254/257; 254/256
(58) Field of Search ..... 254/256, 257, 254/258, 259

(56) References Cited

U.S. PATENT DOCUMENTS

| | | | | | |
|---|---|---|---|---|---|
| 395,146 | A | | 12/1888 | Hunt et al. | |
| 779,218 | A | * | 1/1905 | Harlan | 254/259 |
| 912,845 | A | * | 2/1909 | Haynes | 254/259 |
| 1,053,814 | A | * | 2/1913 | Holladay | 254/259 |
| 1,140,757 | A | | 5/1915 | Meyer | |
| 1,231,493 | A | * | 6/1917 | Clanton | 254/259 |
| 1,359,160 | A | * | 11/1920 | Erway | 254/259 |
| 1,389,814 | A | | 9/1921 | Chapman | |
| 1,429,796 | A | | 9/1922 | Stuttgen | |
| 1,497,566 | A | * | 6/1924 | Ironside | 254/259 |
| 2,484,190 | A | * | 10/1949 | Slingleton | 254/259 |
| 2,497,805 | A | * | 2/1950 | Towse | 254/259 |
| 3,823,914 | A | | 7/1974 | Coil | |

* cited by examiner

*Primary Examiner*—Kathy Matecki
*Assistant Examiner*—Evan Langdon
(74) *Attorney, Agent, or Firm*—Kolisch Hartwell, P.C.

(57) ABSTRACT

A tool for applying a force to a chain. The tool comprises a lever and an attachment member pivotally connected to the lever with two opposed arms pivotally mounted to the lever on opposite sides of the attachment member. Each arm has an end adapted to releasably engage and hold the chain. There is a linkage between the arms to guide movement of the arms upon reciprocal pivotal movement of the lever with respect to the attachment member. The arms are operable in a cycle in which one of the arms is maintained stationary to engage and hold the chain while the other arm is released from the chain and moved parallel to the chain past the stationary arm to engage and hold a new location on the chain whereupon each arm assumes the role of the other arm to repeat the cycle. The tool provides a simple and reliable manually operated device for applying a force to a chain. Mounting a weight to the attachment member allows the tool to be used to lift the weight along a suspended chain. Mounting the attachment member to an anchor point and attaching the chain to a movable object allows the tool to be used as a "come-along" to winch the movable object by the chain toward the anchor point.

18 Claims, 6 Drawing Sheets

CHAIN PULLING DEVICE

FIELD OF THE INVENTION

This invention relates to a device for applying a force to a chain, and, more particularly, to a manually operated tool for pulling a chain.

BACKGROUND OF THE INVENTION

Winching equipment for applying a force to drag or lift an object is well known. In particular, with the increased popularity of off-road recreational vehicles, there is an increased demand for winching units that will allow the vehicle to be rescued in the event that it becomes stuck. In the past, this has often involved equipping the vehicle with a powered winch or similar equipment that can pull a trapped vehicle toward an anchored object by winding a cable or chain about a receiving drum. A power take-off or a separate motor is used to rotate the drum to receive the cable or chain. Winding of the cable or chain about the drum does not generally provide any mechanical advantage and a powerful and expensive winch motor is generally needed. This makes the winch unit expensive and bulky. The winch unit is generally installed on the exterior of the vehicle for ready access and is often exposed to the environment. Since the winch is not used on a regular basis, it tends not to be maintained as diligently as other components of the vehicle. Infrequent use in combination with exposure to the elements often results in the winch unit being prone to failure when needed.

Winches, whether operated manually or by a motor, are also useful for lifting loads vertically or for pulling an object remote from the winch. For example, a winch can be operated to drag a downed tree from a position blocking a road or from a tree felling site to a wood processing area.

SUMMARY OF THE INVENTION

My invention relates to a tool that is particularly useful as an inexpensive replacement for existing winch equipment. I have developed a compact, reliable manually operated tool that provides a significant mechanical advantage. As a winch replacement or "come-along", the tool allows an operator to apply a considerable pulling force to "reel in" a cable or chain.

The tool can also be operated to move along a fixed cable or chain. In this mode of operation, the tool can support a weight that is carried along the cable or chain.

Accordingly, the present invention provides a tool for applying a force to a chain, the tool comprising:

a lever;

an attachment member pivotally connected to the lever;

two opposed arms pivotally mounted to the lever on opposite sides of the attachment member, each arm having an end adapted to releasably engage and hold the chain; and a linkage between the arms to guide movement of the arms upon reciprocal pivotal movement of the lever with respect to the attachment member, the arms being operable in a cycle in which one of the arms is maintained stationary to engage and hold the chain while the other arm is released from the chain and moved generally parallel to the chain past the stationary arm to engage and hold a new location on the chain whereupon each arm assumes the role of the other arm to complete the cycle.

The present inventions also provides a tool for applying a force to a chain, the tool comprising:

a handle;

an attachment member pivotally connected to the handle;

two opposed arms pivotally mounted to the handle on opposite sides of the attachment member, each arm having an end adapted to releasably engage and hold the chain; and a link associated with each arm, each link being pivotally connected at one end to the arm and pivotally connected at the other end to the attachment member to control movement of each arm with respect to the chain on reciprocal pivotal movement of the handle with respect to the attachment member to cause the arms to move in hand-over-hand fashion along the chain such that one arm holds the chain while the other arm moves generally parallel to the chain past the one arm to engage and hold a new location whereupon the other arm holds the chain and the one arm moves in a repeating cycle.

In a further aspect, the present invention provides apparatus comprising:

an elongate member and a tool for travelling along the elongate member, said tool comprising:

a lever;

an attachment member pivotally connected to the lever;

two opposed arms pivotally mounted to the lever on opposite sides of the attachment member, each arm having an end adapted to releasably engage and hold the elongate member;

a linkage between the arms to guide movement of the arms upon reciprocal pivotal movement of the lever with respect to the attachment member, the arms being operable in a cycle in which one of the arms is maintained stationary to engage and hold the elongate member while the other arm is released from the elongate member and moved generally parallel to the elongate member past the stationary arm to engage and hold a new location on the elongate member whereupon each arm assumes the role of the other arm to repeat the cycle.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
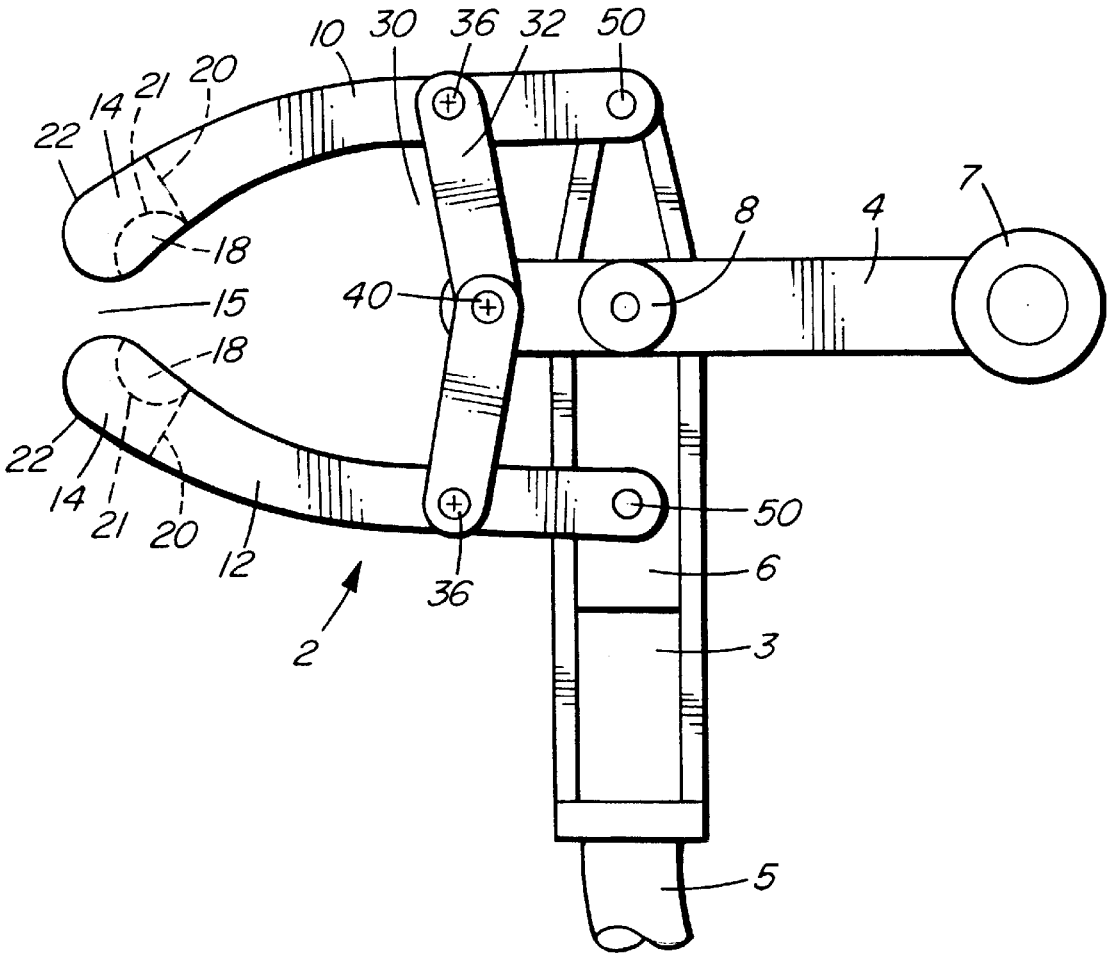
FIG. 1 is a side view of a first embodiment of the tool according to the present invention.

Referring to FIG. 1, there is shown a first embodiment of the tool 2 of the present invention. In this, and following embodiments, the tool is described for use in conjunction with a chain. It will be apparent to a person skilled in the art that the tool of the present invention will work with any elongate member such as a cable, wire, rope etc. that is capable of withstanding the tensile forces generated when the tool is in being manipulated. In order to work with elongate members other than a chain, the arms of the tools must be formed with engaging and gripping portions suitable for holding and releasing the elongate member.

Tool 2 comprises a lever 6 that also functions as an operating handle that is pivotally connected to an attachment member 4 at a first pivot point 8. Preferably, lever 6 includes a cavity 3 to receive a handle 5. Depending on the length of handle 5, the mechanical advantage of the tool can be varied. Attachment member 4 is preferably an elongate limb that includes a connection point 7 for anchoring the tool to a bracing surface or attaching a mass to be moved by the tool.

Figure 1A:
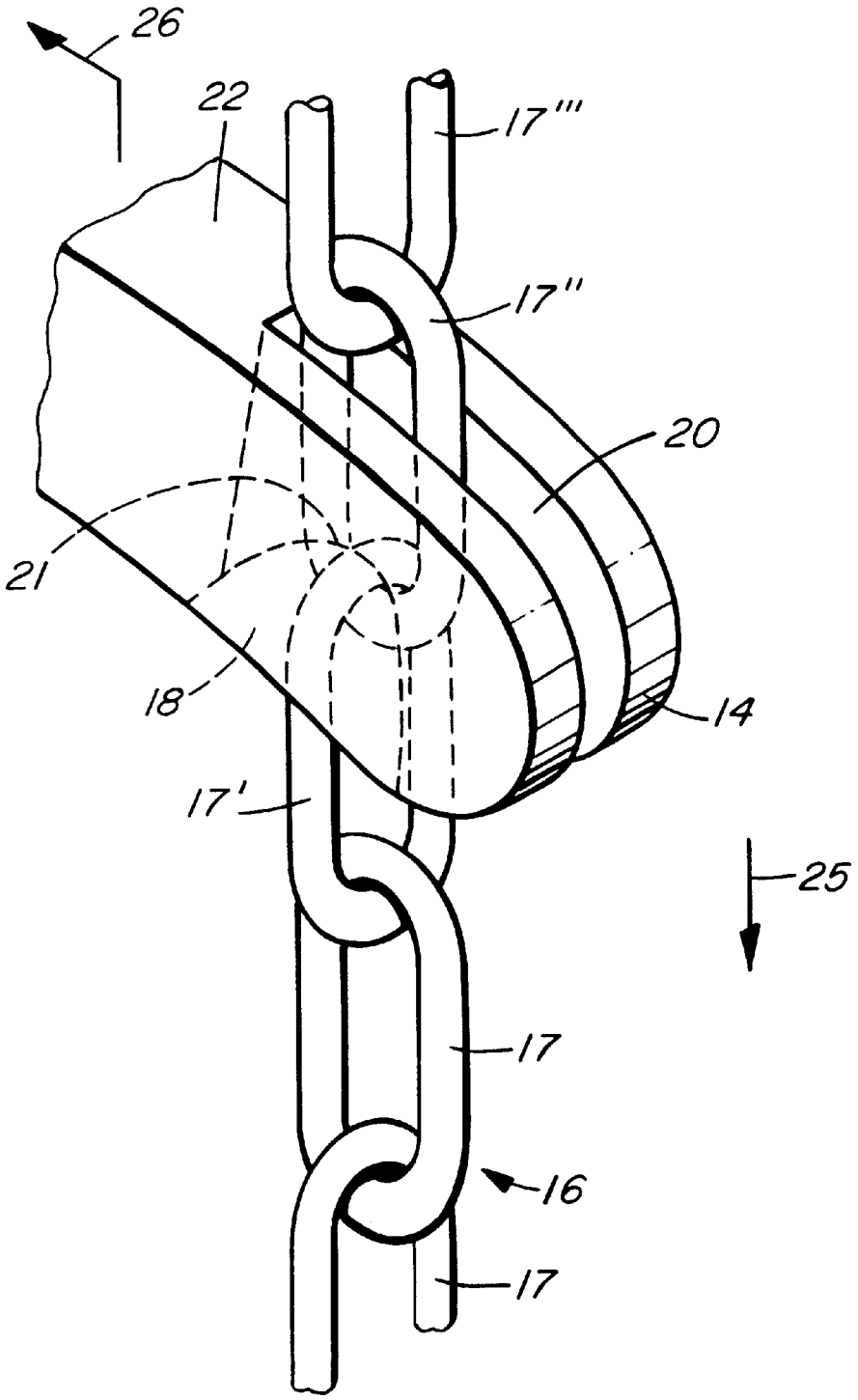
FIG. 1*a* is a detail view showing the chain holding end of an arm.

Two opposed arms 10, 12 are pivotally mounted to lever 6 on opposite sides of attachment member 4. Each arm has an end 14 adapted to releasably engage and hold an elongate member, in this case, a chain 16. Each arm extends forwardly and inwardly from lever 6 to define a clearance gap 15 between arm ends 14. FIG. 1*a* is a detailed view of a preferred arrangement for arm end 14 adapted to work with a chain formed from links 17. Each arm end 14 is formed with a generally dome shaped cavity 18 that is intersected by a slot 20 extending from the roof 21 of the dome to the outer side 22 of the arm. Cavity 18 and slot 20 are dimensioned to permit the arm ends 14 to fit between any pair of similarly oriented links 17' and 17''' and to straddle intermediate link 17''. The arm ends 14 hold the chain by engagement of cavity 18 against a rounded end of link 17'. Slot 20 allows the intermediate link 17'' to extend through the arm end. When a force is applied to the arms in the direction indicated by arrow 25, arm ends 14 reliable and securely engage and hold the chain. While ensuring a secure hold on the chain, the illustrated arrangement also allows arm end 14 to readily release the chain upon upward and outward movement of the arm as indicated by arrow 26.

Returning to FIG. 1, there is a linkage 30 provided between arms 10, 12 to guide or co-ordinate movement of the arms along chain 16 upon manipulation of the tool. In the illustrated embodiment, linkage 30 comprises links 32 and 34 associated with each arm 10 and 12, respectively. Each link 32,34 is pivotally connected at one end to respective arm 10,12 to define second pivot point 36 at each link. The other end of each link is, in turn, pivotally connected to attachment member 4. Preferably, links 32,34 are pivotally connected to attachment member 4 at a third pivot point 40 that is common to the links. In the embodiment of FIG. 1, attachment member 4 is connected to lever 6 such that first pivot point 8 interconnecting attachment member 4 and lever 6 is located between third pivot point 40 and connection point 7. Each arm 10, 12 is pivotally connected to lever 6 at a fourth pivot point 50. Second pivot point 36 interconnecting each link and arm is located intermediate the arm end 14 and the fourth pivot point 50 joining the arm to lever 6.

In operation, the lever 6 is manipulated by the user in a reciprocal pivotal motion with respect to attachment member 4 to move arms 10,12 in an operating cycle in which one of the arms is maintained stationary to engage and hold the chain while the other arm is released from the chain and moved parallel to the chain past the stationary arm to engage and hold a new location on the chain whereupon each arm assumes the role of the other arm to complete the cycle. In other words, the arms move along the chain in hand-over-fashion to either pull the chain toward the tool if the tool is anchored via attachment member 4, or, if the chain is fixed in place to move the tool along the chain pulling a mass mounted to attachment member 4.

Figure 5A:
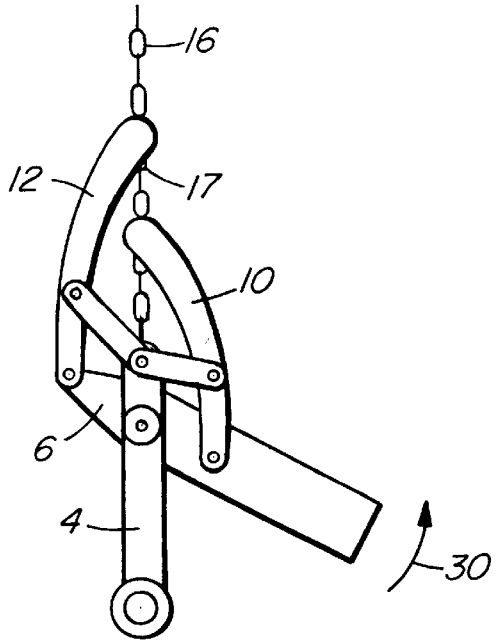
FIGS. 5*a*–5*d* are schematic views showing the operation of the tool of the present invention in movement along a chain.
Figure 5B:
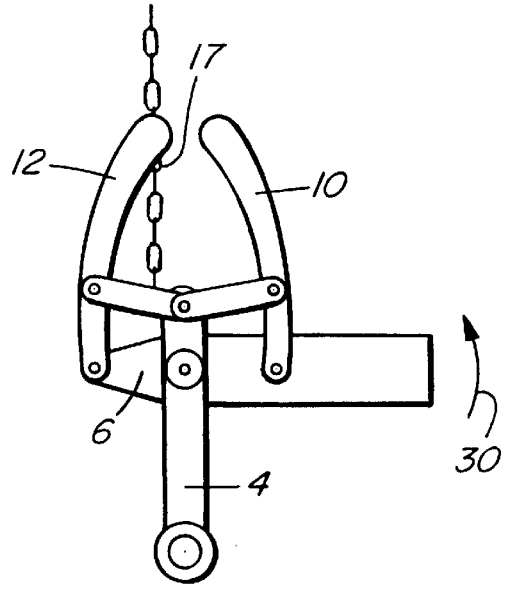
Figure 5C:
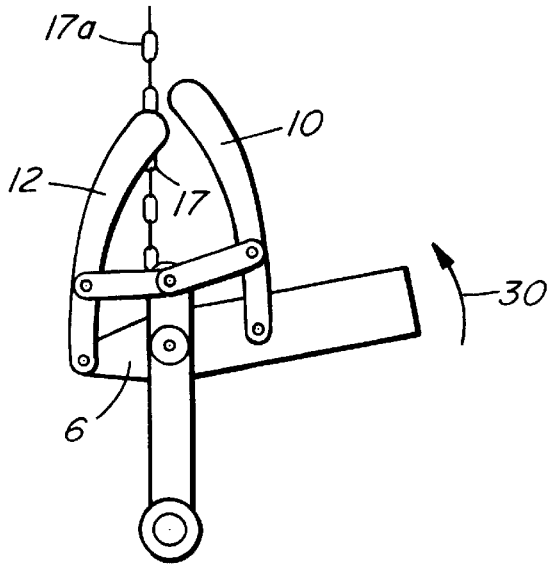
Figure 5D:
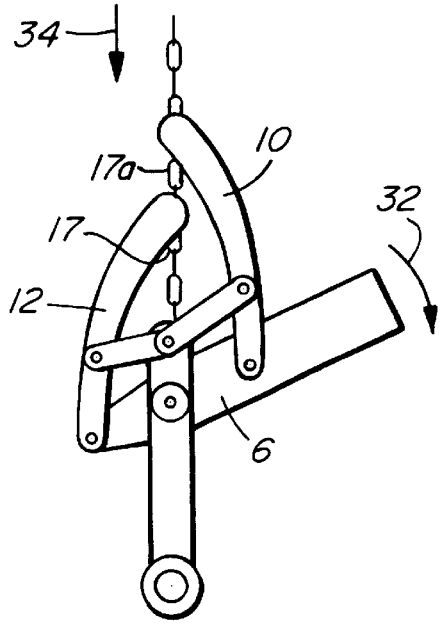

FIGS. 5*a* to 5*d* show a tool according to the embodiment of FIG. 1 in operation. Initially in FIG. 5*a*, lever 6 is pivoted by a user to orient the free ends 14 of arms 10 and 12 for engagement of at least arm 12 to a link 17 defining a holding location on chain 16. Lever 6 is then pivoted counterclockwise in the direction indicated by arrow 30 which causes arm 10 to move upwardly parallel to the chain and past arm 12 which remains stationary with respect to the change and anchored on link 17 as best shown in FIG. 5*b*. In the event that arm 10 is also initially engaged with a link of chain 16, counterclockwise pivoting of lever 6 acts to disengage the arm from the chain and pivot the arm outwardly clear of the chain before moving the arm parallel to the chain. Referring to FIG. 5*c*, as lever 6 continues to pivot in a counterclockwise direction, arm 10 is pivoted to engage a chain link above stationary arm 12. FIG. 5*d* shows arm 10 engaged on a new chain link 17*a* above link 17 and lever 6 being rotated in the opposite clockwise direction as indicated by arrow 32. This motion results in arm 12 being disengaged from link 17 and moved outwardly free of the chain for subsequent movement parallel to the chain and advancement past arm 10 to engage a new link of the chain above link 17*a*. The movement of the arms 10,12 is coordinated by links 32, 43 during reciprocal pivoting of lever 6.

While the above description refers to the tool of the present invention operating along a chain in which the links define a plurality of holding locations for the arms, it will be appreciated that alternative elongate members can be used in conjunction with the tool. For example, the tool operating in the hand-over-hand fashion described above can move along or pull a wire, rope or cable. Arms ends 14 can be formed with appropriate friction gripping attachments to engage and hold the elongate member. The elongate member is preferably formed with a plurality of spaced holding locations along its length to be engaged and held by the arms. For example, a rope would preferably be formed with spaced knots along its length to create holding locations for the arms. A wire or cable would be formed with barbs or other protrusions.

Figure 2:
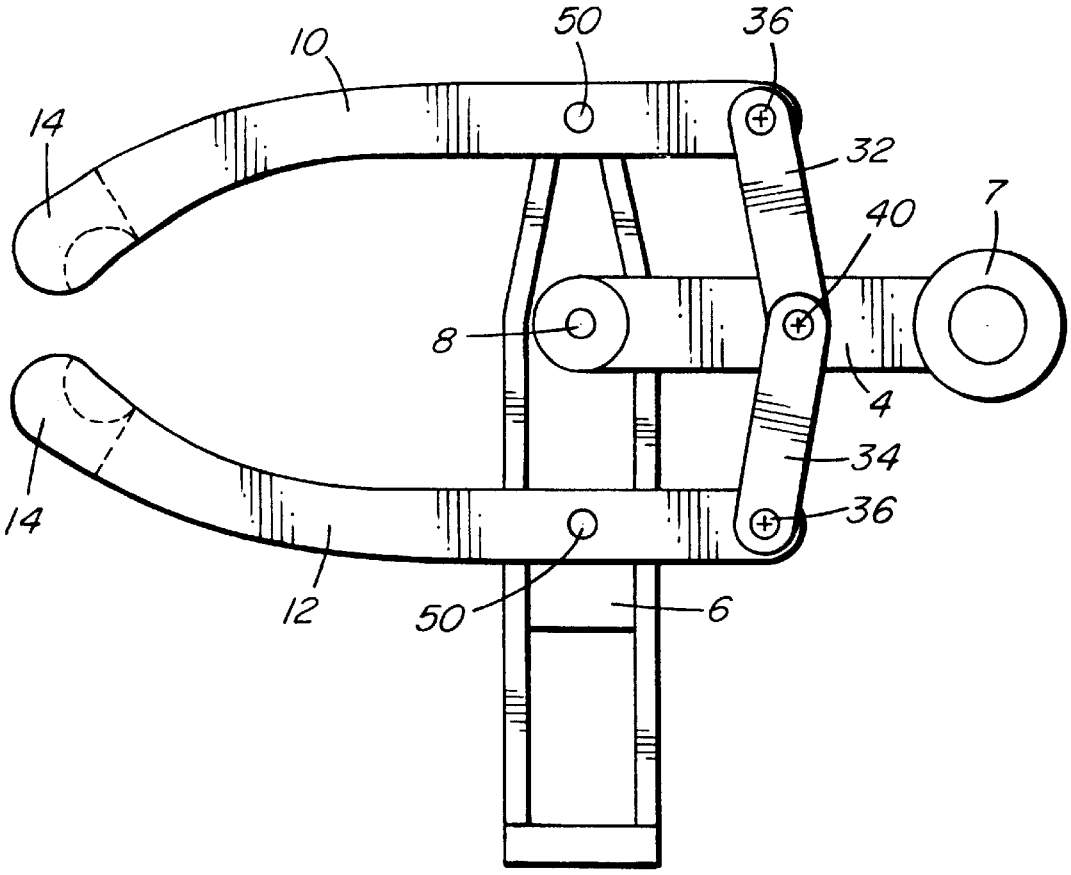
FIG. 2 is a side view of a second embodiment of the tool according to the present invention.
Figure 3:
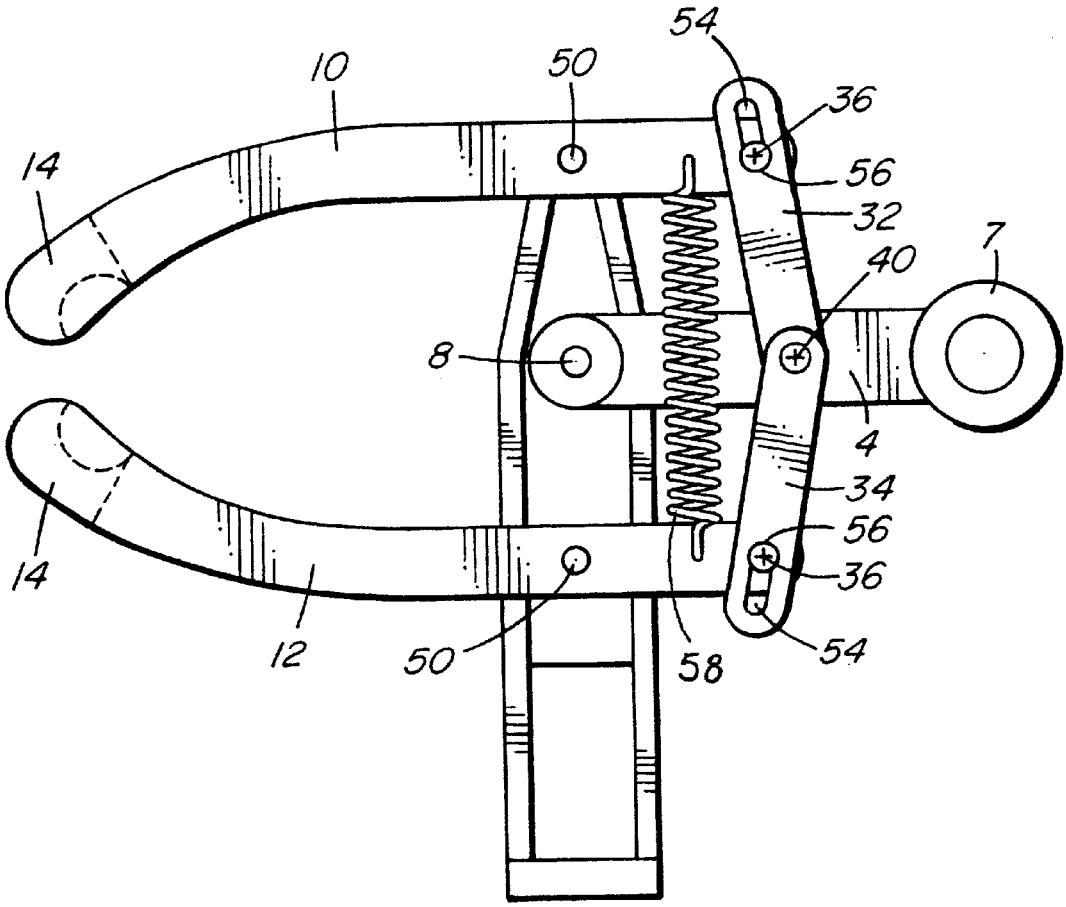
FIG. 3 is a side view of a third embodiment of the tool according to the present invention.
Figure 4:
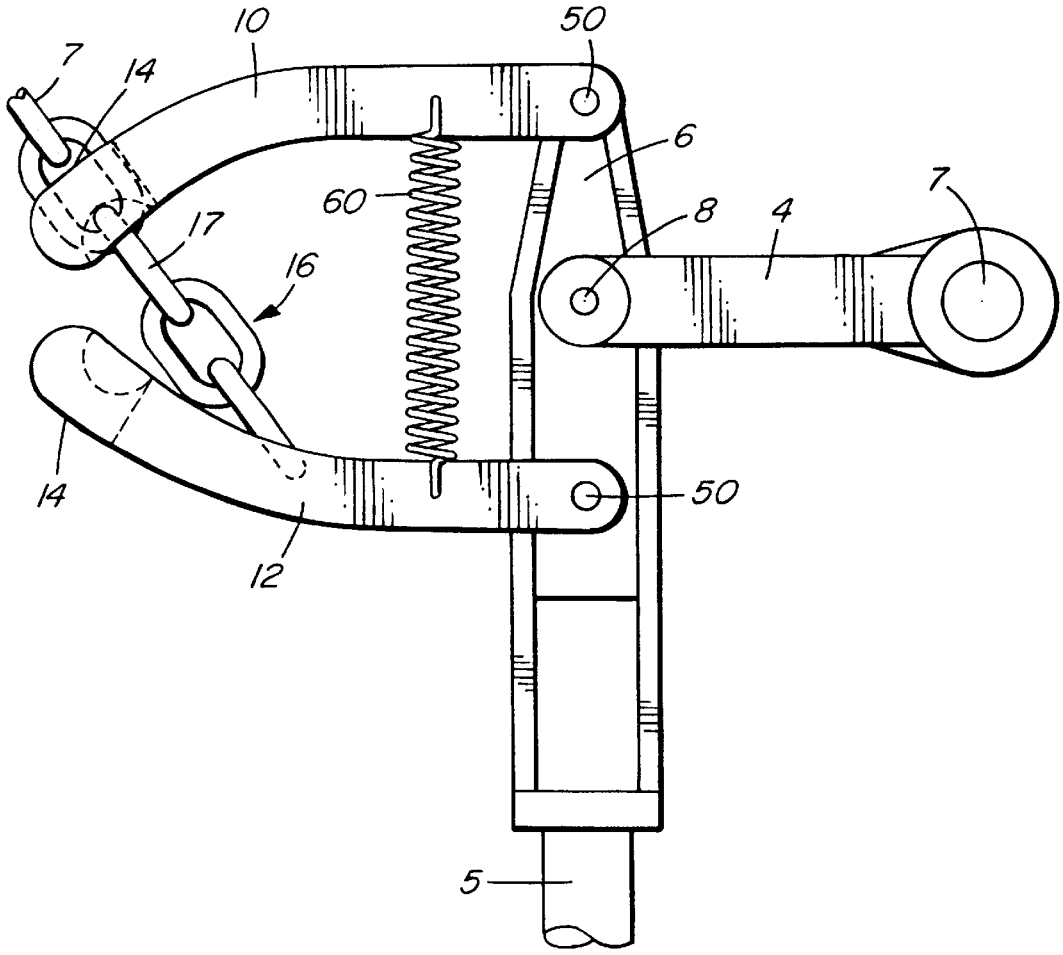
FIG. 4 is a side view of a fourth embodiment of the tool according to the present invention.

Other geometries of the tool of the present invention are possible as illustrated in the additional embodiments of FIGS. 2 to 4. In each case, the same parts as the first embodiment are referenced using identical numbers.

FIG. 2 illustrates an embodiment in which third pivot point 40, where links 32,34 connect to attachment member 4, is located between the first pivot point 8 and connection point 7. This embodiment uses a shorter attachment member 4 than the first embodiment. In the present embodiment, the attachment member ends at the first pivot point 8 and does not extend past lever 6 between arms 10,12 as in the embodiment of FIG. 1. The present embodiment also has longer arms 10 and 12 which each extend past the fourth pivot points 50 connecting each arm to lever 6. In this case, fourth pivot points50 are intermediate the second pivot points 36 (interconnecting the links 32,34 and the arms 10,12) and the arm ends 14 adapted to releasably engage and hold the chain.

FIG. 3 shows a further embodiment similar to the embodiment of FIG. 2. The tool of FIG. 3 includes links 32, 34 which have second pivot points 36 adapted to move with respect to each link to accommodate additional pivoting of arms 10 and 12 about fourth pivot point 50. Movement of pivot points 36 is preferably achieved by forming a slot 54 in each link through which the threaded fastener 56 defining the pivot point extends. This arrangement allows additional pivoting of ends 14 of arms 10 and 12 to permit clearance past chain links. Preferably, a biasing member in the form of spring 58 extending between arms 10 and 12 is provided to bias the arms to a default position in which the pivot point 36 is at the inner end of each slot 54.

FIG. 4 shows a still further embodiment of the tool of the present invention in which the linkage between the arms comprises a resilient member adapted to bias the arms toward each other. Preferably, the biasing member is a helical spring 60.

Although the present invention has been described in some detail by way of example for purposes of clarity and understanding, it will be apparent that certain changes and modifications may be practised within the scope of the appended claims.

I claim:

1. A tool for applying a force to a chain, the tool comprising:

a lever;

an attachment member pivotally connected to the lever at a first pivot point;

two opposed arms pivotally mounted to the lever on opposite sides of the attachment member, each arm having an end adapted to releasably engage and hold the chain; and a linkage between the arms to guide movement of the arms upon reciprocal pivotal movement of the lever with respect to the attachment member, the linkage comprising a link associated with each arm, each link being pivotally connected at one end to one of the arms at a second pivot point, and each link being pivotally connected at the other end to the attachment member, the arms being operable in a cycle in which one of the arms is maintained stationary to engage and hold the chain while the other arm is released from the chain and moved generally parallel to the chain past the stationary arm to engage and hold a new location on the chain whereupon each arm assumes the role of the other arm to complete the cycle.

2. A tool as claimed in claim 1 in which the end of each arm is formed with a cavity intersected by a slot to engage the links of the chain.

3. A tool as claimed in claim 2 in which the cavity is dome shaped.

4. A tool as claimed in claim 1 in which the attachment member comprises an elongate member pivotally mounted to the lever at the first pivot point and includes a connection point for anchoring the tool or attaching a mass.

5. A tool as claimed in claim 4 in which the links are pivotally connected to the attachment member at a third pivot point that is common to the links.

6. A tool as claimed in claim 5 in which the third pivot point is located between the first pivot point and the connection point.

7. A tool as claimed in claim 5 in which the first pivot point is located between the third pivot point and the connection point.

8. A tool as claimed in claim 1 in which each arm is pivotally connected to the lever at a fourth pivot point, and the second pivot point between the link and the arm is intermediate the arm end adapted to releasably engage and hold the chain and the fourth pivot point.

9. A tool as claimed in claim 1 in each arm is pivotally connected to the lever at a fourth pivot point with the fourth pivot point being intermediate the second pivot point between the link and the arm and the end adapted to releasably engage and hold the chain.

10. A tool as claimed in claim 9 in which the second pivot point is adapted to move with respect to the link to accommodate additional pivoting of each arm about the fourth pivot point.

11. A tool as claimed in claim 10 including a slot in the link to permit movement of the second pivot point with respect to the link.

12. A tool as claimed in claim 10 including a biasing member extending between the arms.

13. A tool as claimed in claim 1 in which the lever is formed with a cavity to receive a handle.

14. A tool for applying a force to a chain, the tool comprising:

a lever;

an attachment member pivotally connected to the lever;

two opposed arms pivotally mounted to the lever on opposite sides of the attachment member, each arm having an end adapted to releasably engage and hold the chain; and a link associated with each arm, each link being pivotally connected at one end to the arm and pivotally connected at the other end to the attachment member to control movement of each arm with respect to the chain on reciprocal pivotal movement of the lever with respect to the attachment member to cause the arms to move in hand-over-hand fashion along the chain such that one arm holds the chain while the other arm moves generally parallel to the chain past the one arm to engage and hold a new location whereupon the other arm holds the chain and the one arm moves in a repeating cycle.

15. A tool for movement along an elongate member comprising:

a lever;

an attachment member pivotally connected to the lever;

two opposed arms pivotally mounted to the lever on opposite sides of the attachment member, each arm having an end adapted to releasably engage and hold the elongate member;

a linkage between the arms to guide movement of the arms upon reciprocal pivotal movement of the lever with respect to the attachment member, the linkage comprising a link associated with each arm, each link being pivotally connected at one end to one of the arms, and each link being pivotally connected at the other end to the attachment member, the arms being operable in a cycle in which one of the arms is maintained stationary to engage and hold the elongate member while the other arm is released from the elongate member and moved generally parallel to the elongate member past the stationary arm to engage and hold a new location on the elongate member whereupon each arm assumes the role of the other arm to repeat the cycle.

16. A tool as claimed in claim 15 in which the elongate member is formed with a plurality of holding locations along the length of the elongate member to be held by the arms.

17. A tool as claimed in claim 16 in which the elongate member is a chain and the plurality of holding locations are the links of the chain.

18. Apparatus comprising:

an elongate member and a tool for travelling along the elongate member, said tool comprising:

a lever;

an attachment member pivotally connected to the lever;

two opposed arms pivotally mounted to the lever on opposite sides of the attachment member, each arm having an end adapted to releasably engage and hold the elongate member;

a linkage between the arms to guide movement of the arms upon reciprocal pivotal movement of the lever with respect to the attachment member, the linkage comprising a link associated with each arm, each link being pivotally connected at one end to one of the arms, and each link being pivotally connected at the other end to the attachment member, the arms being operable in a cycle in which one of the arms is maintained stationary to engage and hold the elongate member while the other arm is released from the elongate member and moved generally parallel to the elongate member past the stationary arm to engage and hold a new location on the elongate member whereupon each arm assumes the role of the other arm to repeat the cycle.

* * * * *